US005110261A

United States Patent [19]

Junkin

[11] Patent Number: 5,110,261

[45] Date of Patent: May 5, 1992

[54] FAN BLADE

[75] Inventor: Leigh A. Junkin, Somerville, Tenn.

[73] Assignee: Hunter Fan Company, Memphis, Tenn.

[21] Appl. No.: 548,079

[22] Filed: Jul. 5, 1990

[51] Int. Cl.[5] ..... F01D 5/30

[52] U.S. Cl. ..... 416/204 R; 416/5; 416/62; 416/132 A

[58] Field of Search ..... 416/132 A, 223 R, 196 A, 416/62, 204 R, 224, 227 R, 5; D23/377, 385, 411, 413

[56] References Cited

U.S. PATENT DOCUMENTS

| | | | |
|---|---|---|---|
| 238,313 | 3/1881 | Solomons | 416/230 |
| D. 285,720 | 9/1986 | Markwardt | D23/377 |
| D. 306,643 | 3/1990 | Taylor, III | D23/413 |
| D. 309,183 | 7/1990 | Taylor, III | D23/413 |
| D. 313,467 | 1/1991 | Frampton | D23/379 |
| 359,374 | 3/1887 | Wright | 416/240 |
| 781,657 | 2/1905 | Jones | 416/111 |
| 925,031 | 6/1909 | Russel | 416/5 |
| 1,516,668 | 11/1924 | Burch | 416/132 B |
| 1,686,214 | 10/1928 | Kyle | 416/210 |
| 1,811,441 | 6/1931 | Smith | 416/240 |
| 1,868,113 | 7/1932 | Ljungstrom | 416/240 |
| 2,390,789 | 12/1945 | Haskell | 416/230 |
| 2,632,598 | 3/1953 | Wales, Jr. | 416/240 |
| 3,260,312 | 7/1966 | Elmer | 416/240 |
| 3,597,108 | 8/1971 | Mercer et al. | 416/139 |
| 4,218,183 | 8/1980 | Dall-Winther | 416/132 B |
| 4,248,568 | 2/1981 | Lechner | 416/132 B |
| 4,676,721 | 6/1987 | Hardee | 416/146 R |
| 4,832,572 | 5/1989 | Purcha et al. | 416/146 R |

OTHER PUBLICATIONS

A Breath of Fresh Air for Ceiling Fans, Wineta Inc. Apr. 1988.

*Primary Examiner*—John T. Kwon

*Attorney, Agent, or Firm*—Heiskell, Donelson, Bearman, Adams, Williams & Kirsch

[57] ABSTRACT

A ceiling fan blade is provided having a generally rigid unitary frame, with three areas for secure attachment to a conventional blade iron providing three points of attachment. A flexible, weather-resistant cover is removably secured to the frame by hook-and-loop fastening material. The attachment areas are angularly offset from the plane of the blade to increase the blade's angle of attack as it moves through the air during normal use.

11 Claims, 3 Drawing Sheets

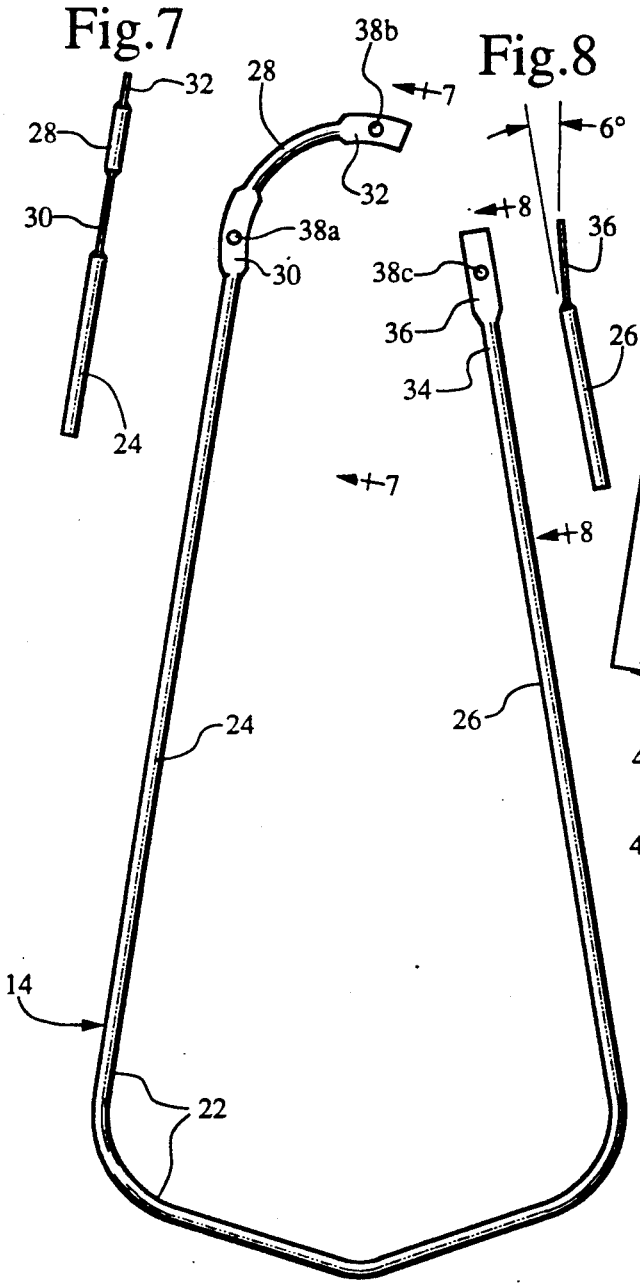
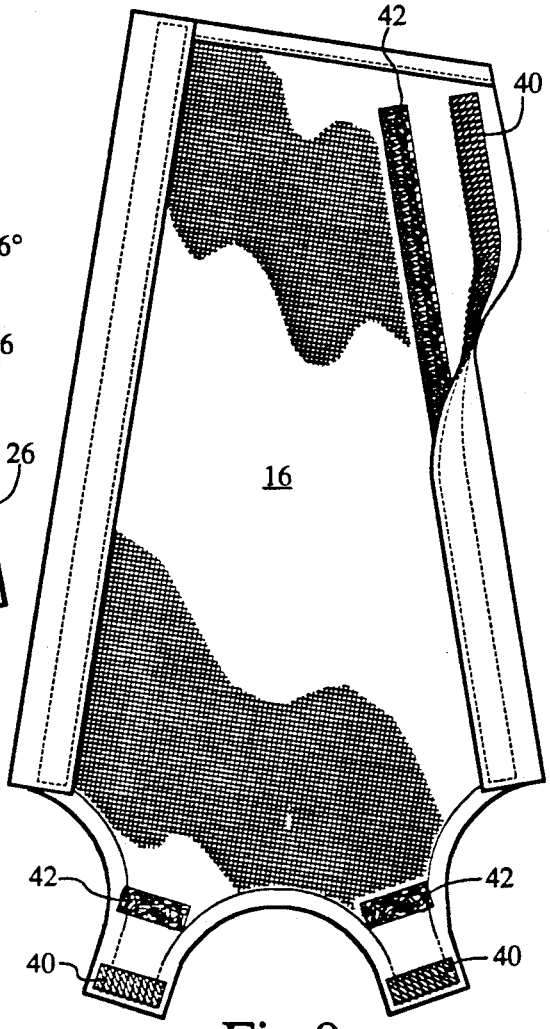
Fig.9
Fig.5
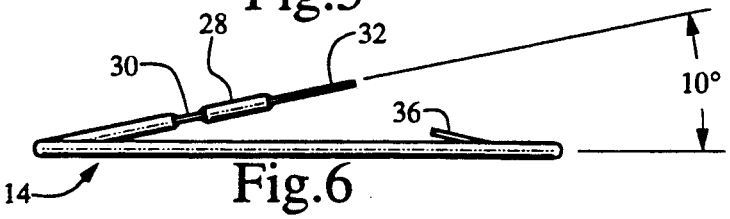
Fig.6

FAN BLADE

BACKGROUND OF THE INVENTION

1. Field

The present invention relates generally to a ceiling fan blade and, more particularly, to such blade having a frame and a removable covering, the frame being configured for stable attachment to a conventional blade iron.

2. Description of the Prior Art

Blades for conventional ceiling fans have been manufactured from numerous materials in a variety of shapes and sizes. Generally, the environment in which the ceiling fan is intended to operate is a significant factor in the selection of the material for the blade composition. Rigid materials such as wood or plastic are commonly used on fans intended solely for indoor use, but are prone to warping when subjected to long-term outdoor use due to the extreme fluctuations in temperature and/or humidity. One aspect of fan blade construction which has become standardized is the mounting structure for attaching blades to fan motors, commonly referred to as the "blade iron," which typically attaches to the blades at three points.

In order for a blade to be suitable for continued outdoor use, it is known to provide the blade with a relatively thin frame having a flexible fabric covering or insert, both frame and fabric being virtually impervious to extreme and/or fluctuating weather conditions. The frame for such a blade is typically made of a single metal rod bent into the shape of a more conventional blade, with one or both ends of the rod being attached to one or two of the three mounting points provided on a conventional blade iron. The cover or insert for the frame is typically made of nylon or some other synthetic fabric suitable for outdoor use.

Prior art fan blades as described above do a credible job of withstanding the elements. However, such blades are typically much less stable than their solid counterparts, due to their relative light weight and one or two point attachment to the blade iron. As a consequence of this instability problem, known fan blades of the cloth-over-frame construction are only suited for use with relatively low fan speeds.

SUMMARY OF THE INVENTION

A principal object of the present invention is to provide a ceiling fan blade which is well suited for outdoor use, and provides the stability normally associated with conventional wooden blades. Another object of this invention is to provide a ceiling fan blade which has a lightweight frame covered by a weatherproof fabric, the frame being adapted for attachment at three points to a conventional blade iron. A still further object of this invention is to provide an acceptably stable blade suitable for outdoor use, having a covering which is easily removed and/or replaced.

The preferred embodiment of the invention disclosed herein achieves these objectives by providing a unitary frame formed from a single aluminum rod. The central portion of the rod is bent to define the outer dimensions and shape of the fan blade, with the ends having mounting holes formed therethrough for attaching the frame to a conventional blade iron. One end of the rod is left essentially straight, and contains a single hole for mounting to one of the three mounting points on the blade iron. The other end, however, is uniquely bent into an arc and contains two holes for attachment to the remaining two points on the blade iron. The three-point attachment provided by this frame results in a degree of stability previously unknown in the art for such blades. A removable cloth cover fits snugly around the frame, and is held in place by conveniently positioned hook-and-loop fastening material. The mounting ends of the frame are preferably angled upwardly to increase the angle of attack of the blade as it passes through the air, thereby reducing the speed of the fan motor and further improving the blade's overall stability.

Other advantages and features of the present invention will become more readily apparent in the following detailed description, when read in conjunction with the accompanying drawings.

BRIEF DESCRIPTION OF THE DRAWINGS

FIG. 5 is a top plan view of the frame portion of the present invention;

FIG. 6 is an end elevational view of the frame portion shown in FIG. 5;

FIG. 7 is a side elevational view of a segment of the frame of the present invention, taken generally along line 7—7 of FIG. 5;

FIG. 8 is a side elevational view of a section of the frame of the present invention, taken generally along line 8—8 of FIG. 5; and FIG. 9 is a top plan view of the fabric covering for the fan blade of the present invention, showing the hook-and-loop fastening material in a state of partial disengagement.

DESCRIPTION OF THE PREFERRED EMBODIMENT

Figure 1:
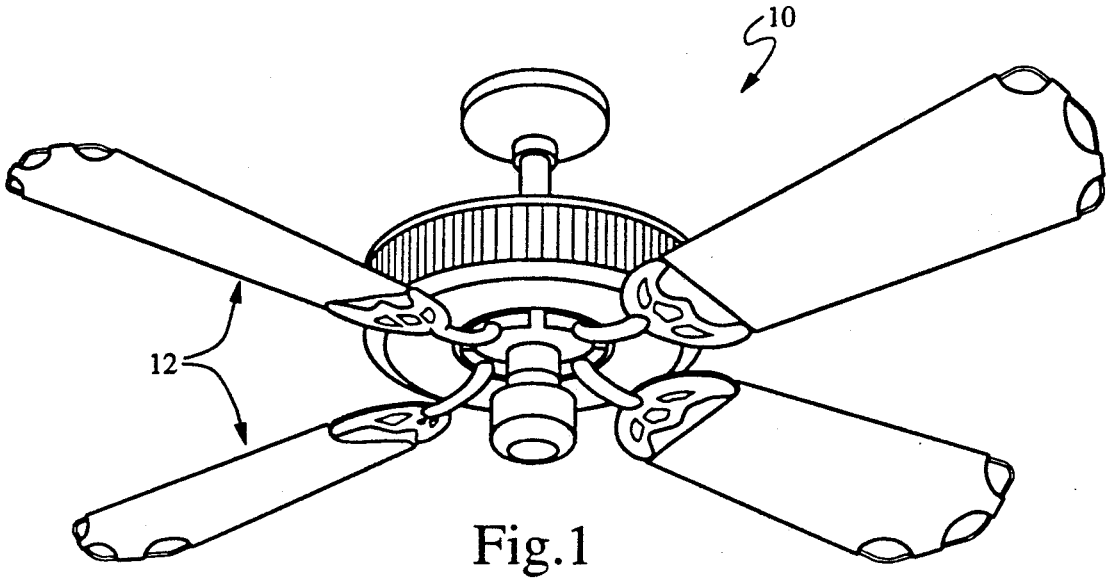
FIG. 1 is a perspective view of a ceiling fan having blades constructed in accordance with the preferred embodiment of the present invention.
Figure 4:
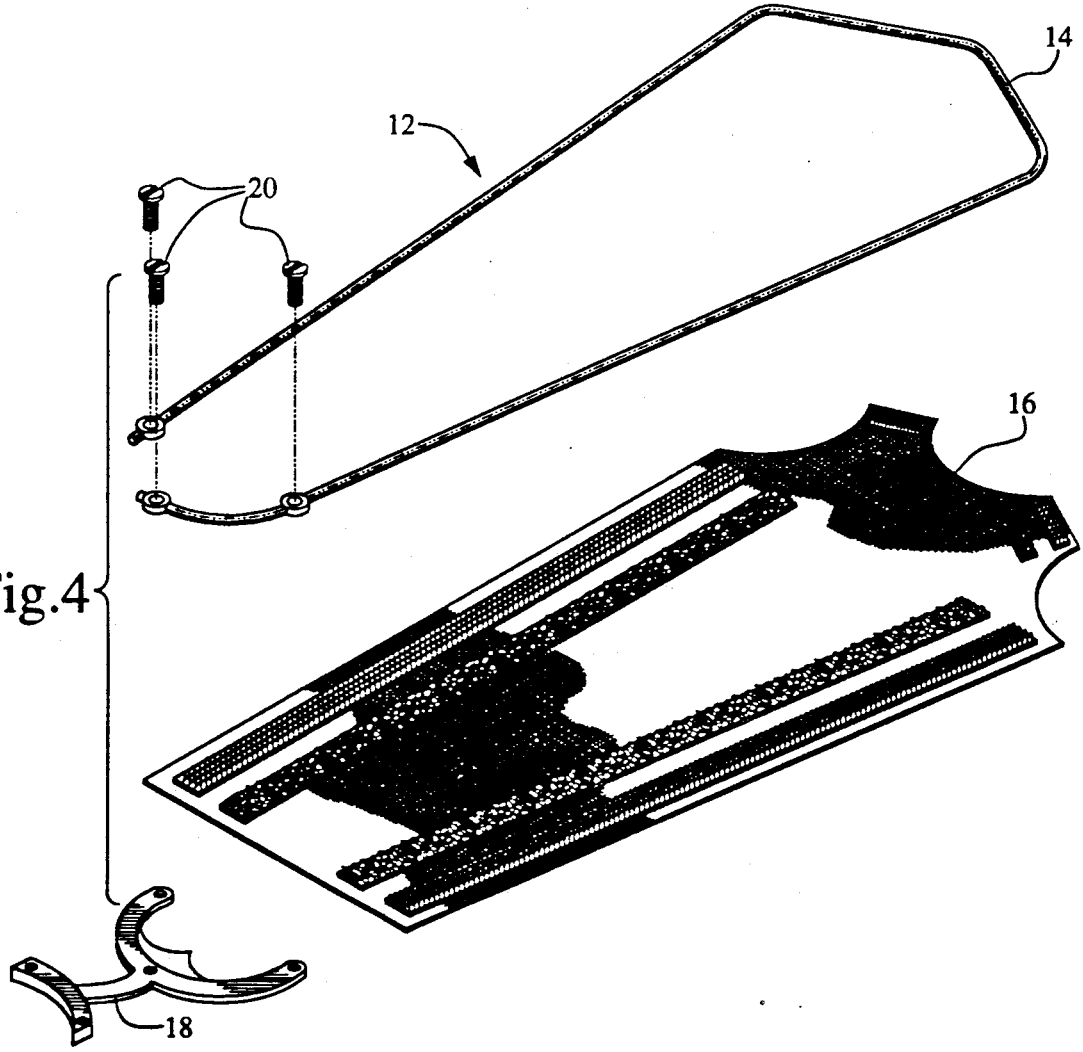
FIG. 4 is an exploded perspective view of the present invention.
Figure 2:
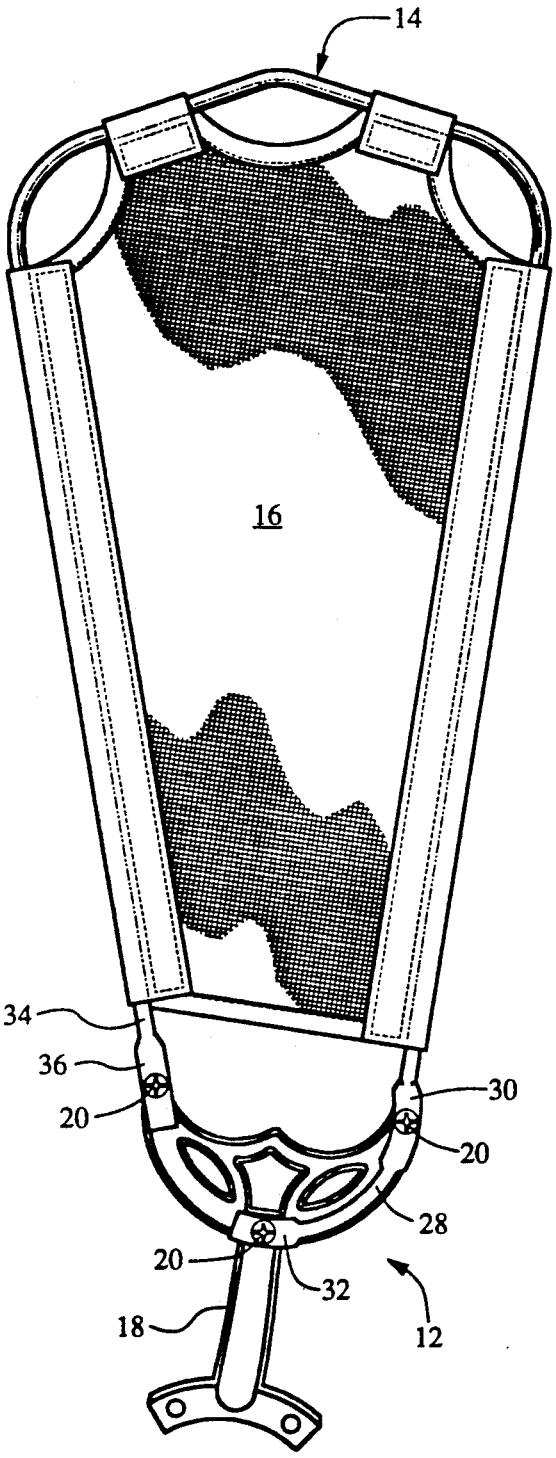
FIG. 2 is a top plan view of the present invention.
Figure 3:
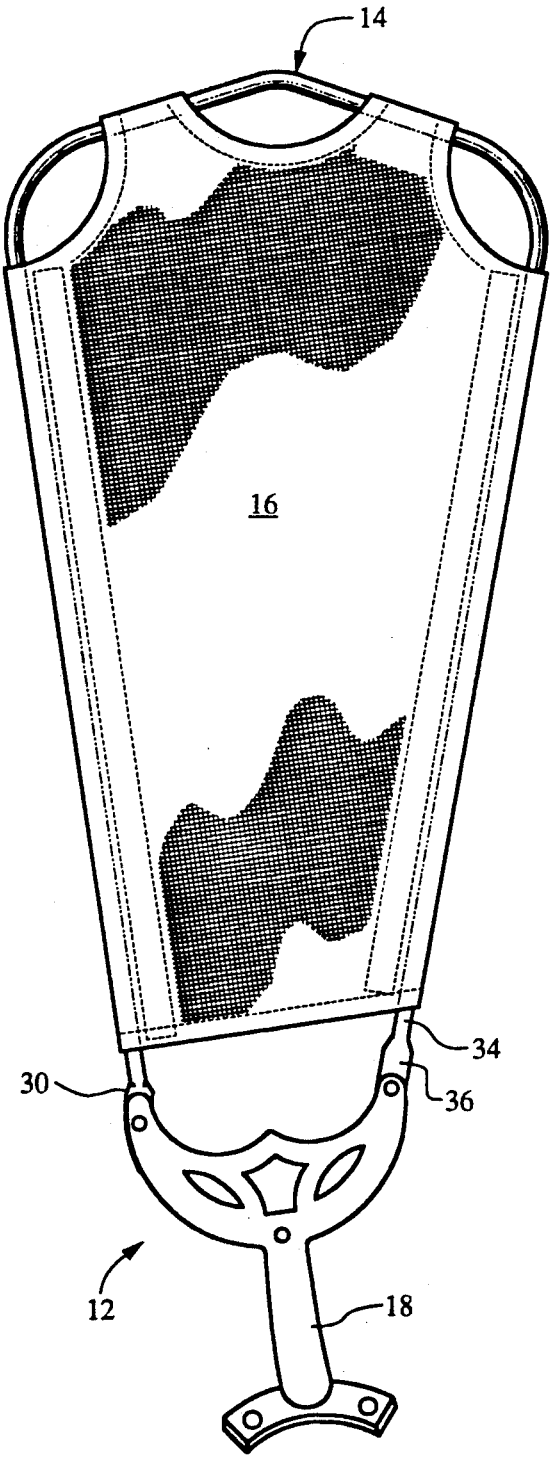
FIG. 3 is a bottom plan view of the present invention.

Completely assembling ceiling fan 10, as illustrated in FIG. 1, includes four blades 12, each of which represents the preferred embodiment of the present invention. The components of each fan blade 12, as best illustrated in FIG. 4, consist of frame 14, cover 16, blade iron 18, and screws 20. Those skilled in the art will appreciate the fact that blade iron 18 is a conventional mounting structure used by most ceiling fan manufacturers to attach the blades to the fan motor, and that the hole pattern shown is essentially universal.

Referring now to FIGS. 5 through 8, frame 14 consists of a central portion of 22 having generally longitudinally extending legs 24 and 26. End portion 28 of leg 24 is formed in an arc, and includes flattened attachment areas 30 and 32. Similarly, end portion 34 of leg 26 includes flattened attachment area 36, with attachment areas 30, 32, and 36 having mounting holes 38*a*, *b*, and *c* disposed therethrough for receiving mounting screws 20 in the manner show in FIG. 4.

Referring more specifically now to FIGS. 6 and 8, central portion 22 of frame 14 lies substantially in a single plane, with end portions 28 and 34 angularly offset therefrom. The angular displacement of end portion 28 is preferably achieved by twisting leg 24 with sufficient torsional force to permanently set end portion 28 at an angle of approximately ten degrees relative to the plane defined by central portion 22. End portion 36, on the other hand, may simply be bent to an angle of about six degrees relative to leg 26. As those skilled in the art will understand, blade iron 18 is designed to hold blade 12 at a standard angle of attack. By displacing end portions 28 and 34 as disclosed herein, this angle of attack is increased, thereby increasing the force of the air acting on blade 12. The unique three point attachment provide by end portions 28 and 34, coupled with the increased air pressure on blade 12, results in a novel lightweight fan blade having the stability of a much heavier conventional blade.

FIGS. 4 and 9 best illustrate the preferred embodiment of cover 16, which is a suitably configured panel of flexible material with strips of hook-and-loop fastening material attached thereto. For purposes of weatherability, cover 16 is preferably made of nylon or a similar polymer fiber, but the selection of the materials should have no effect on the scope of the present invention. Likewise, mating halves 40 and 42 of hook-and-loop fastening material were chosen for their durability, as well as their simple operation and relatively low cost. It will be readily understood that any number of fastening means, such as snaps, buttons, zippers, or even adhesives, may be suitable for the purposes disclosed herein without departing from the nature and scope of the present invention.

As disclosed herein, frame 14 consists of a single aluminum rod having an essentially round cross-sectional configuration, flattened at attachment areas 30, 32, and 36. Furthermore, central portion 22 is shown to define the configuration of a conventional wooden blade. Those skilled in the art will fully understand that frame 14 could be formed from any suitably rigid metal, plastic, or other composition, and could be formed in the appropriate configuration by casting, molding, forging, or any other suitable conventional manufacturing process. Round aluminum rod is preferable primarily because it is easy to bend, readily available, sufficiently strong, and relatively inexpensive. The configuration of frame 14 is also optional, and may be selected to duplicate any shape suitable for the purpose.

While the principle of providing a fan blade having a lightweight, weather-resistant frame and cover, with the frame having three points of attachment to the blade iron for added stability has been made clear, it will be immediately apparent to those skilled in the art that there are many possible modification to the disclosed arrangements without departing from the basic spirit of the present invention. Accordingly, the following claims are intended to cover and embrace not only the specific embodiment disclosed herein, but also such modifications within the spirit and scope of this invention.

What I claim is:

1. A rotary fan blade, configured for attachment to a conventional mounting structure having three points of attachment to said blade, comprising:

a generally rigid frame, comprising a single formed member defining the outer configuration of said blade, having first and second legs, said first leg having a distal end with dual attachment means associated therewith for attaching said frame to two of said three points of attachment on said mounting structure, said second leg having a distal end with a single attachment means associated therewith for attaching said frame to the third said point of attachment on said mounting structure; and a cover securable to said frame.

2. A rotary fan blade as described in claim 1, wherein:

said frame further comprises a rod formed so that said outer configuration of said blade lies essentially in a plane, the distal ends of said first and second legs not being included in said outer configuration of said blade;

said distal end of said first leg comprises an arcuately formed section of said rod, said dual attachment means being disposed thereon; and said single attachment means is disposed on said distal end of said second leg.

3. A rotary fan blade as described in claim 2, wherein said rod is composed of aluminum.

4. A rotary fan blade as described in claim 1, wherein said dual and single attachment means comprises generally flattened sections of said frame, having holes formed therethrough suitable for receiving mounting screws.

5. A rotary fan blade configured for attachment to a conventional mounting structure having three points of attachment to said blade, comprising:

a generally rigid frame, comprising a single formed member defining the outer configuration of said blade, having first and second legs, said first leg having a distal end with dual attachment means associated therewith for attaching said frame to two of said three points of attachment on said mounting structure.

said second leg having a distal end with a single attachment means associated therewtih for attaching said frame to the third said point of attachment on said mounting structure; and a cover securable to said frame, wherein said distal ends of said first and second legs are angularly offset from said plane.

6. A rotary fan blade as described in claim 5, wherein:

the angle of offset of said distal end of said first leg is approximately ten degrees.

7. A rotary fan blade as describe din claim 5, wherein:

the angle of offset of said distal end of said second leg is approximately six degrees.

8. A rotary fan blade configured for attachment to a conventional mounting structure having three points of attachment for said blade, comprising:

a frame, comprising a single formed member having a central portion and first and second end portions, said central portion defining the outer configuration of said blade, said central portion being substantially in a single plane, said frame including first, second, and third attachment means operatively disposed thereon for cooperation with said three points of attachment on said mounting structure; and a cover, removably securable to said frame, wherein said first end portion of said frame is angularly displaced from said plane.

9. A rotary fan blade as described in claim 8, wherein said second end portion of said frame is angularly displaced from said plane.

10. A rotary fan blade as described in claim 9, wherein the angle of displacement between said second end portion and said plane is approximately six degrees.

11. A rotary fan blade as described in claim 8, wherein the angle of displacement between said first end portion and said plane is approximately ten degrees.

* * * * *

UNITED STATES PATENT AND TRADEMARK OFFICE

CERTIFICATE OF CORRECTION

PATENT NO. : 5,110,261

DATED : May 5, 1992

INVENTOR(S) : Leigh A. Junkin

It is certified that error appears in the above-indentified patent and that said Letters Patent is hereby corrected as shown below:

In the Abstract:
In the second line please delete the "," after the word frame.

Col. 4, line 41, after the word "as", please correct the words "describe din" to read as --described in--.

Signed and Sealed this

Eighth Day of March, 1994

Bruce Lehman

*Attest:*

BRUCE LEHMAN

*Attesting Officer*

*Commissioner of Patents and Trademarks*